US011752595B1

(12) United States Patent
Feldthouse

(10) Patent No.: US 11,752,595 B1
(45) Date of Patent: Sep. 12, 2023

(54) WOOD WORKPIECE LEVELING DEVICE

(71) Applicant: Ryan Feldthouse, Fresno, CA (US)

(72) Inventor: Ryan Feldthouse, Fresno, CA (US)

( * ) Notice: Subject to any disclaimer, the term of this patent is extended or adjusted under 35 U.S.C. 154(b) by 0 days.

(21) Appl. No.: 17/704,024

(22) Filed: Mar. 25, 2022

(51) Int. Cl.
*B25B 5/00* (2006.01)
*B25B 5/16* (2006.01)

(52) U.S. Cl.
CPC ..... *B25B 5/003* (2013.01); *B25B 5/006* (2013.01); *B25B 5/16* (2013.01)

(58) Field of Classification Search
CPC . B25H 1/08; B23K 2101/006; B23P 2700/50; Y10S 269/90
USPC ..... 269/169, 16, 136, 137, 138, 37, 40, 45, 269/71, 72, 141, 3, 6, 248, 143; 248/121, 248/122.1, 124.1, 125.1, 354.1, 354.3, 248/354.4, 201, 70
See application file for complete search history.

(56) References Cited

U.S. PATENT DOCUMENTS 2,676,413 A * 4/1954 Wharton ..... B23Q 1/01 269/297
4,141,524 A * 2/1979 Corvese, Jr. ..... F16L 3/00 5/503.1
4,363,459 A * 12/1982 Holzer ..... E06B 9/323 248/265

OTHER PUBLICATIONS

NICEYRIG Long Lens Support Bracket Height Adjustable with 15mm Rod Rail Clamp—2784 (NICEYRIG Long Lens Support Bracket Height Adjustable with 15mm Rod Rail Clamp—2784 : Buy Online at Best Price in KSA—Souq is now Amazon.sa: (Electronics), Mar. 19, 2021 (Year: 2021).*

* cited by examiner

*Primary Examiner* — Tyrone V Hall, Jr.
*Assistant Examiner* — Abbie E Quann
(74) *Attorney, Agent, or Firm* — SIERRA IP LAW, PC; William K. Nelson

(57) ABSTRACT

The present invention provides an adjustable bar clamp leveling device operable to receive a plurality of conventional woodworking bar clamps and provide space above and below a workpiece for positioning cauls and clamps to the workpiece a glue-up. A plurality of bar clamp leveling devices may be incorporated into a workbench with or without T-slots for securing a workpiece at various positions while maintaining planar alignment of the workpiece components during a glue-up.

20 Claims, 7 Drawing Sheets

WOOD WORKPIECE LEVELING DEVICE

FIELD OF THE INVENTION

The present invention incorporates an adjustable height leveling plate with an insert operable receive conventional woodworking bar clamps. The present invention further relates method of using such device to elevating a wood workpiece during glue-ups, bar clamp leveling equipment that provides space above and below the workpiece for cauls and clamps.

BACKGROUND OF THE INVENTION

Woodworkers often require larger project parts than are available to the consumer for a particular workpiece. A large panel is made by gluing smaller panels together to get a large flat panel to form a glue-up. The panels are arranged in a series and aligned using various alignment aids such as a level or clamping at each glue joint. The arranged panels are positioned between the clamping faces of a clamp (e.g., bar clamp), and the clamps apply pressure to the arranged panel's peripheral, causing glues to squeeze out between the joint. The clamps are typically placed on top of a workbench, and additional clamps are used to secure the workpiece to a top surface of the workbench to level the upper or lower surfaces of the glue-up panel. However, a workbench upper surface may be unlevel, and the clamps may attach to the wood panel at varying angles. An uneven glue-up is problematic and may require reworking the workpiece, e.g., through re-planing.

Some clamps have been developed to elevate the workpiece above the workbench top surface, and may include a height adjustment to level the workpiece and provide an even clamping surface and a space operable to accommodate cauls and clamps above and below the workpiece. Nevertheless, when using this method, the panels may still have uneven alignment due to the surface of the workbench top surface. However, no solution or device has been developed to provide a level workpiece in an elevated space for positioning cauls and clamps and is operable to receive conventional and existing clamps.

SUMMARY OF THE INVENTION

The present invention provides a wood workpiece leveling device and system operable to receive conventional wood clamps and methods of using such a device. The invention may include a plurality of leveling devices that can be individually adjusted to create to level a work surface or workpiece regardless of any slope in a table to which the devices are attached, thereby avoiding the limitations of conventional clamping systems. A leveling device according to the present invention may include two pieces (1) an angle bracket and (2) an alignment plate. The alignment plate is operable to linearly translate along a vertical plate of the angle bracket to adjust the alignment plate's top surface height. The angle bracket may be a rigid structure in the shape of "L," one arm of which is fixed to a bottom surface (e.g., base plate), the other projecting out vertically (e.g., vertical plate) to receive the alignment plate. The base plate of the angle bracket may be attached to a top surface of a workbench with a fastener (e.g., a threaded fastener), and the vertical plate may have a guide (e.g., path, groove, channel, etc.) on the back surface (e.g., a surface opposite to the base plate). The vertical plate includes a longitudinal slot through the plate at a centerline, the slot extending between the vertical plate top surface and the base of the angle bracket. Similarly, an alignment plate may have a slot through the plate at the centerline may align with the vertical plate slot. The alignment plate may have a front surface with a channel operable to receive the vertical plate guide and a concavity operable to receive a shaft of a rod clamp mechanism.

The vertical plate and alignment plate may couple at the guide path and channel and have controlled linear motion along the guide path. A fastener is placed between the vertical plate and alignment plate slots and acts as a pin preventing the alignment plate from being removed from the angle bracket. The height of the alignment plate may be configured by sliding the alignment plate to the desired position, and then the fastener may be secured, thereby compressing the alignment plate to the angle bracket to fix the height. In some embodiments, the fastener may be threaded and a threaded knob may be operable to receive the threading of the fastener and allow for hand tightening and untightening when leveling the alignment plate. Typically, two leveling devices are positioned at opposite ends of the workbench to support the shaft of a rod clamp on opposite ends to secure the workpiece between the clamping surfaces and leveling devices.

In some embodiments, the alignment plate concavity may have a groove operable to receive a removable and replaceable rod alignment insert. The rod alignment insert may have a bottom edge complementary to the concavity grove and may have an upper edge with a geometry corresponding to the geometry of the rod clamp shaft. Rod clamp shaft geometries may be substantially, square, circular with varying diameters, rectangular, and I-beam. The alignment insert used may be switched based on the geometry of the rod clamp. The alignment plate may have an adjustable range of about three and three-quarter inches (3¾") and may position a rod clamp shaft at a minimum height of about five inches (5") and a maximum height of about eight and three-quarter inches (8¾") with respect to a top surface of the workbench or bottom of the angle bracket base plate.

In some embodiments, a workbench may have a T-slot on the top surface for modularly configuring objects and workpieces to the top surface. In such embodiments, the angle bracket base plate may be secured to the workbench with a T-slot bolt and fastened using a knob fastener or a nut. A pair of leveling devices may be aligned by sliding a leveling device along the T-slot path to the desired location and measuring the alignment with a level. The base plate may have a square channel operable to receive a square portion of a T-slot bolt and prevent rotation of the leveling device about the centerline of the bolt.

In some implementations, a workbench may include two T-slot rails positioned symmetrically at opposite ends of a workbench, and a plurality of leveling devices may be positioned in each of the T-slots and each of the leveling devices having a corresponding leveling device on the opposite rail. For simplicity, a description of configuring four leveling devices and two pairs on opposite rails are discussed. However, it is to be understood that the steps configuring the leveling devices may be repeated for subsequent leveling processes for additional devices. Each of the pair of leveling devices is secured to each of the T-slot rails, and each leveling device's angle bracket may be aligned with its corresponding leveling device, and the base plates of each angle bracket may be secured to the T-slot. The alignment plate height of opposite and adjacent leveling devices may be calibrated using a level, and the height of each plate may be fixed by securing a fastener (e.g., a nut or knob fastener) when the desired position and configuration is attained. A rod alignment insert corresponding to the rod clamp shaft geometry may be placed in each of the alignment plate grooves, and the rod clamp may be placed into each alignment insert. A level may be used to check for planar alignment along the rod clamp shaft and horizontal alignment between adjacent rod clamp shafts. If there is an inconsistency in height when calibrating, the alignment plates may be adjusted to provide a straight and true surface. The rod clamps may then be removed from the leveling devices, and the workpiece may be secured between the pair of rod clamps and transferred to the leveling devices. The height and position of the alignment plate and the rod clamps are such that the workpiece may be elevated from the tabletop with space sufficient to accommodate cauls and clamps for compressing the workpiece's top and bottom surface to prevent vertical slip of the panels.

It is an aspect of the present invention to provide a clamp leveling device for elevating a workpiece above a workbench during a work process (e.g., gluing up flat panels), the device comprising: an angle bracket having a base plate securing to a workbench with a fastener and a vertical plate orthogonal to an edge of the base plate, the vertical plate having a central positioning slot and a linear guide on a back side; an alignment plate having a central alignment slot, a concavity on a top surface operable to receive a bar clamp shaft, and a front surface with a channel operable to engage with the linear guide slidably; and an alignment fastener positioned through the positioning slot and alignment slot and operable to secure the alignment plate to the angle bracket plate with a fastening knob. Wherein the elongated position of the alignment plate may be configured by sliding the alignment plate along the linear guide and anchoring the alignment fastener with the fastening knob the alignment plate concavity positioning the bar clamp above a top surface of a workbench. The workbench includes a T-slot track for receiving the base plate fastener and providing adjustments to the position of the leveling device. The linear guide may have a dovetail geometry protruding from the back side, and the alignment plate channel may have a geometry complementary to the linear guide geometry. The central positioning slot and central alignment slot may have the same width and complement the diameter of the alignment fastener. The fastening knob may be operable to engage with the threading of the alignment fastener. The base plate fastener engages with the threading of a fastening knob and is anchored in the adjusted position. The alignment plate concavity may further include a slot operable to receive a removable and replaceable alignment insert, wherein the alignment insert has a geometry complementary to the geometry of the bar clamp shaft. The workbench may have a pair of leveling devices secured to opposite sides of the workbench and have symmetric positions about a centerline of the workbench and are operable to support opposite ends of said bar clamp. The pair of leveling devices may be configured at the same height and position a workpiece in free space above said workbench.

It is a further aspect of the present invention to provide a method for positioning a bar clamp leveling device and a workpiece therein above a workbench, the method comprising: positioning and fastening a pair of clamp leveling devices to opposite ends of a workbench T-slot, the clamp leveling devices comprising: an angled bracket having a T-slot bolt protruding through a base plate and a vertical plate having a centering slot and a linear guide on a back surface; and an alignment plate having a channel operable to slidably engage with the vertical plate and an alignment slot operable to receive a fastener for securing the alignment plate to the vertical plate with a fastening knob; adjusting the height of each alignment plate such that a top surface of each alignment plate is level, and anchoring the alignment plate configuration to the clamp leveling device with the fastener and fastening knob; positioning a bar clamp shaft into a concavity of each of the alignment plates top surfaces; and securing the workpiece above the workbench top surface with the bar clamps wherein the pair of clamp leveling devices are symmetrical about a centerline of the workbench and may be repeatedly positioned along said T-slot of said workbench to provide multiple clamping points on said workpiece. The pair of clamp leveling devices are configured at the same height and have the same position in each of said workbench T-slots. The workpiece is elevated at a position operable to receive a plurality of cauls and clamps on the top and bottom surfaces for preventing the vertical slip of panels in the workpiece.

Further aspects and embodiments will be apparent to those having skill in the art from the description and disclosure provided herein.

It is an object of the present invention to provide a clamp leveling device operable to elevate and level conventional and existing bar clamps above a workbench table top to provide space for receiving cauls and clamps.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

Figure 1:
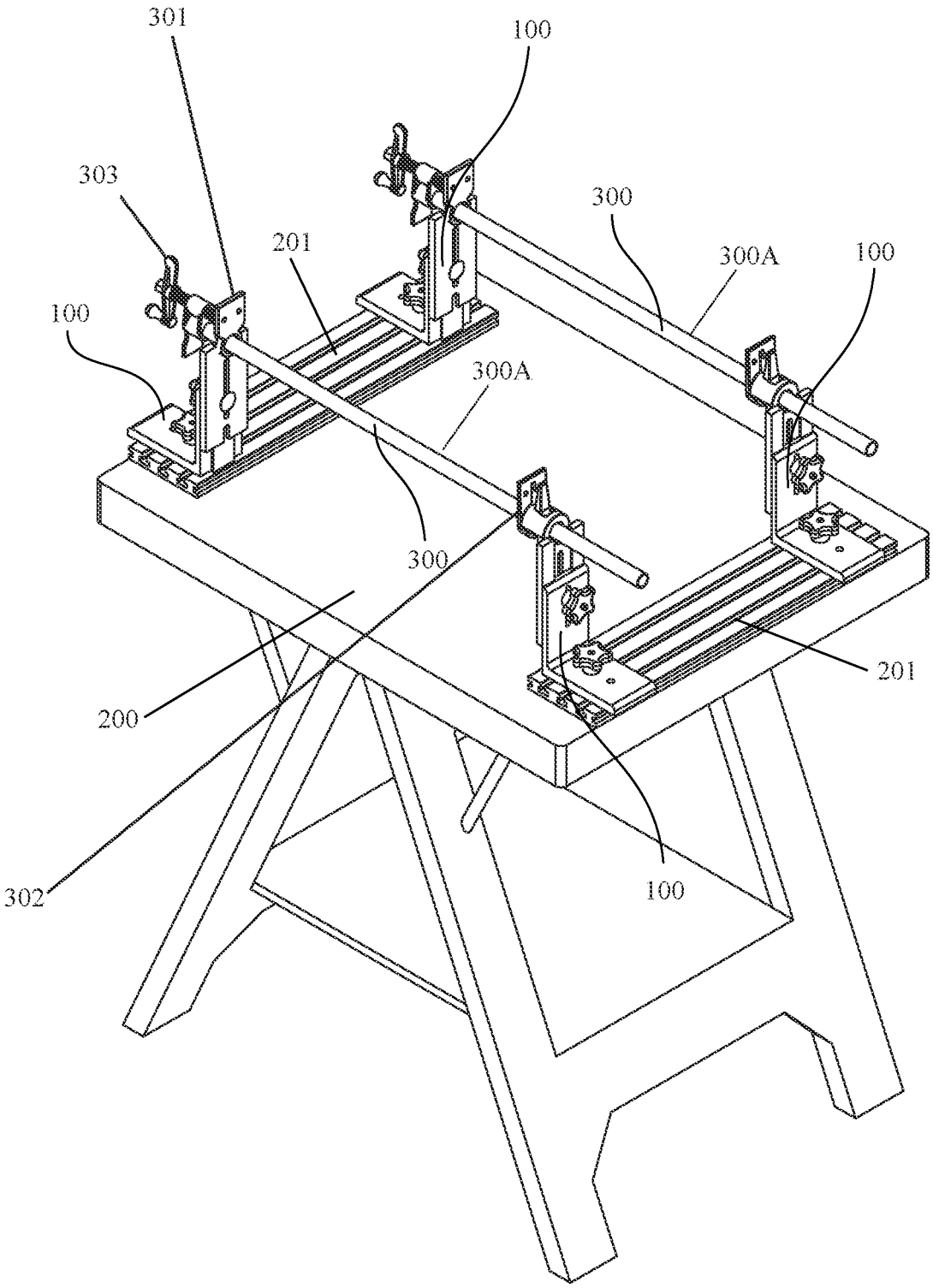
FIG. 1 provides a perspective view of an exemplary workbench securing a plurality of clamp leveling devices, each supporting a woodworking clamp, according to an embodiment of the present invention.
Figure 2:
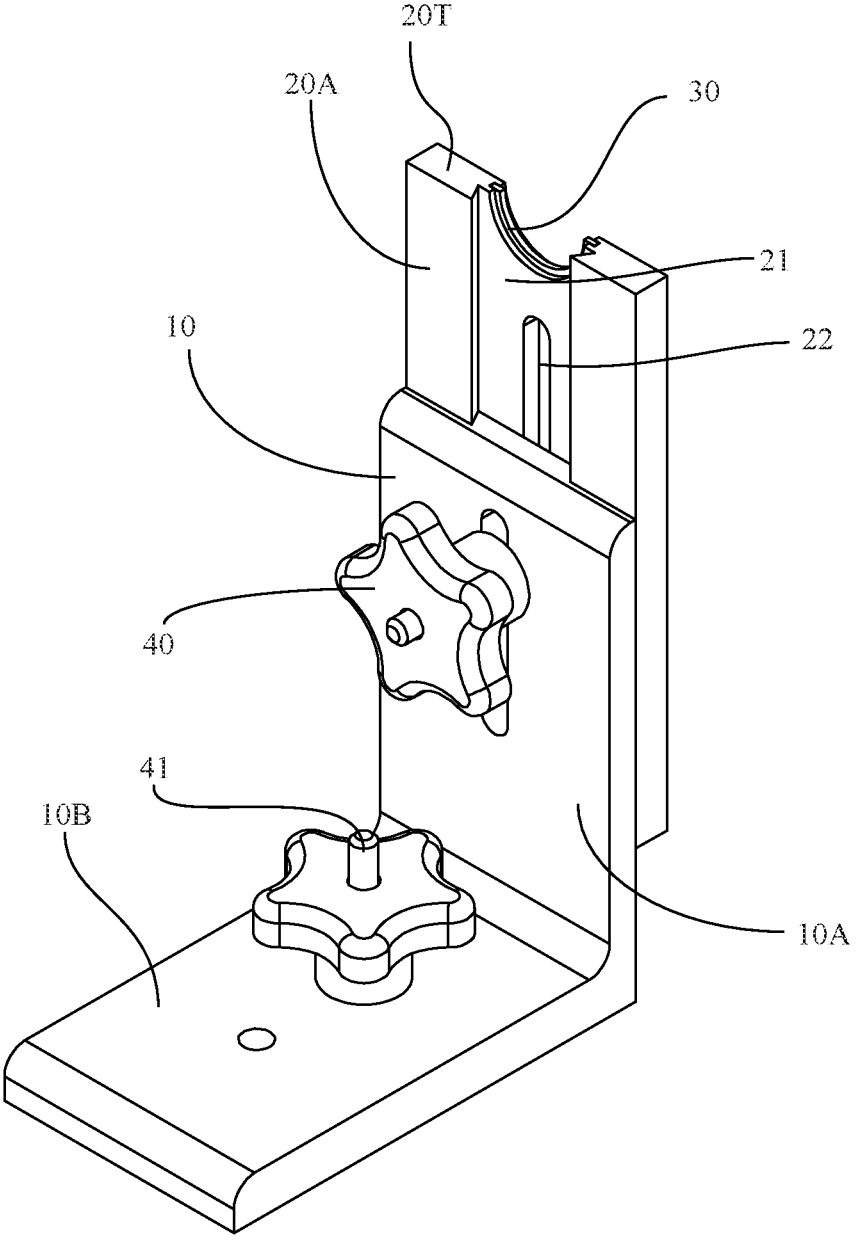
FIG. 2 provides a perspective view of a clamp leveling device, according to an embodiment of the present invention.
Figure 3:
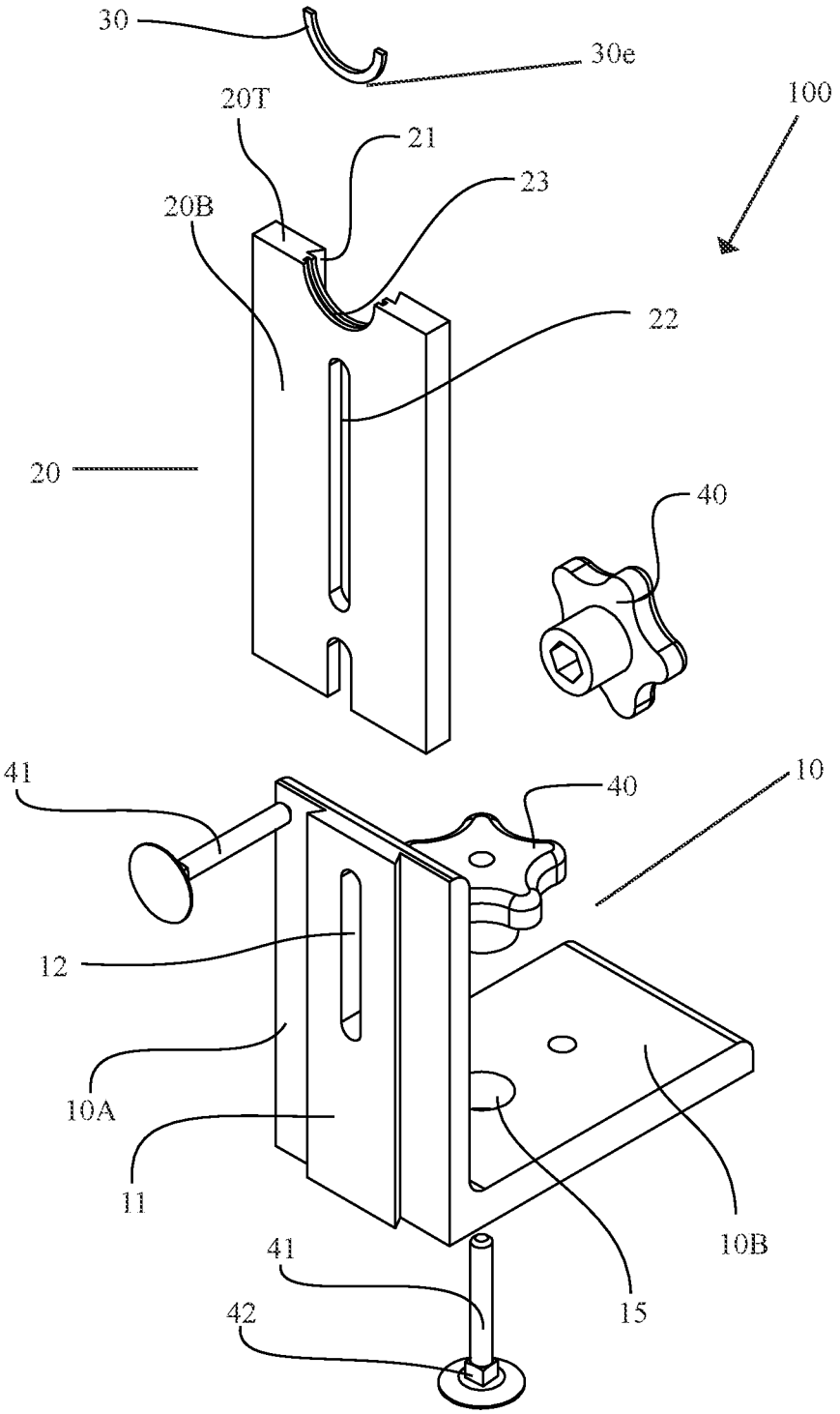
FIG. 3 provides an exploded rear perspective view of a clamp leveling device, according to an embodiment of the present invention.
Figure 4:
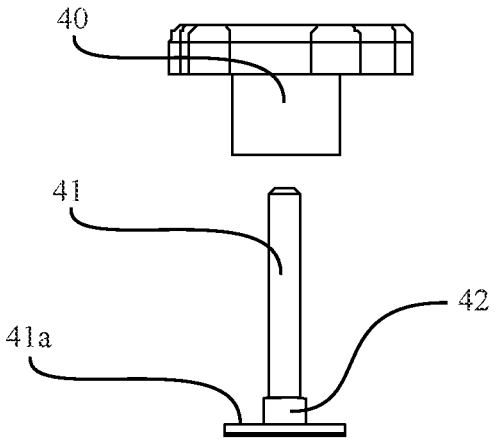
FIG. 4 provides a fastener and fastener knob, according to an embodiment of the present invention.
Figure 8A:
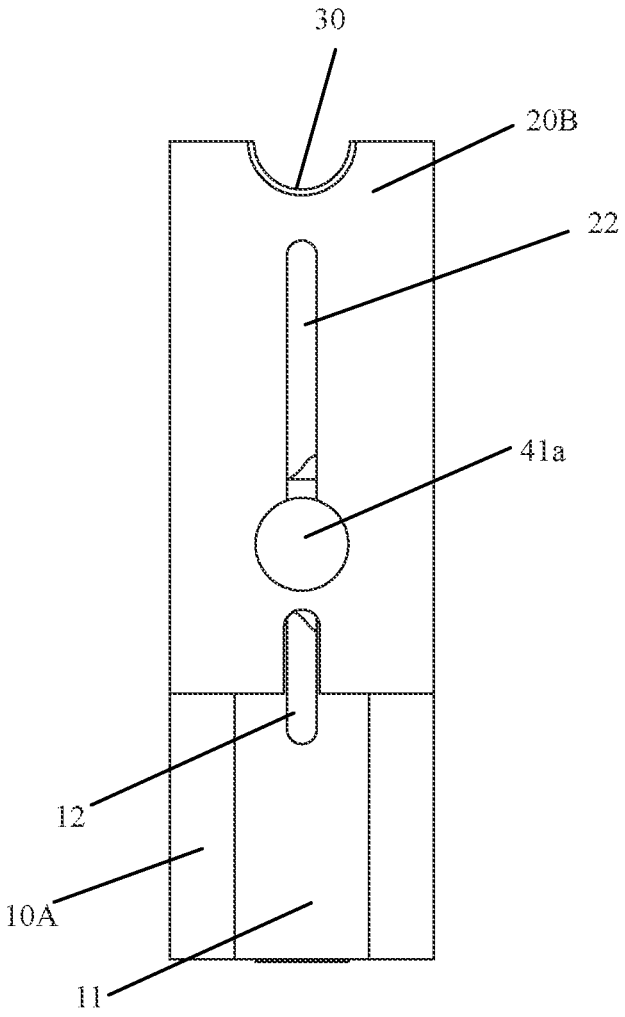
FIG. 8A provides a rear view of a clamp leveling device configured at the maximum height, according to an embodiment of the present invention.
Figure 8B:
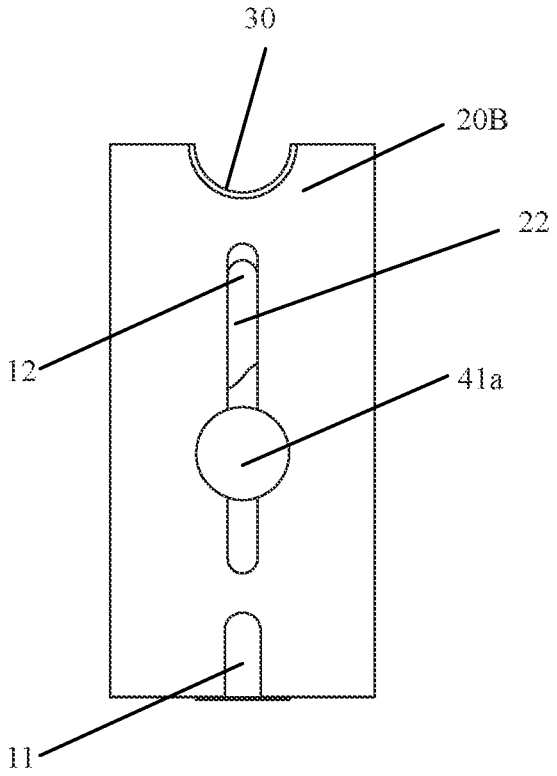
FIG. 8B provides a rear view of a clamp leveling device configured at the minimum height, according to an embodiment of the present invention.
Figure 9:
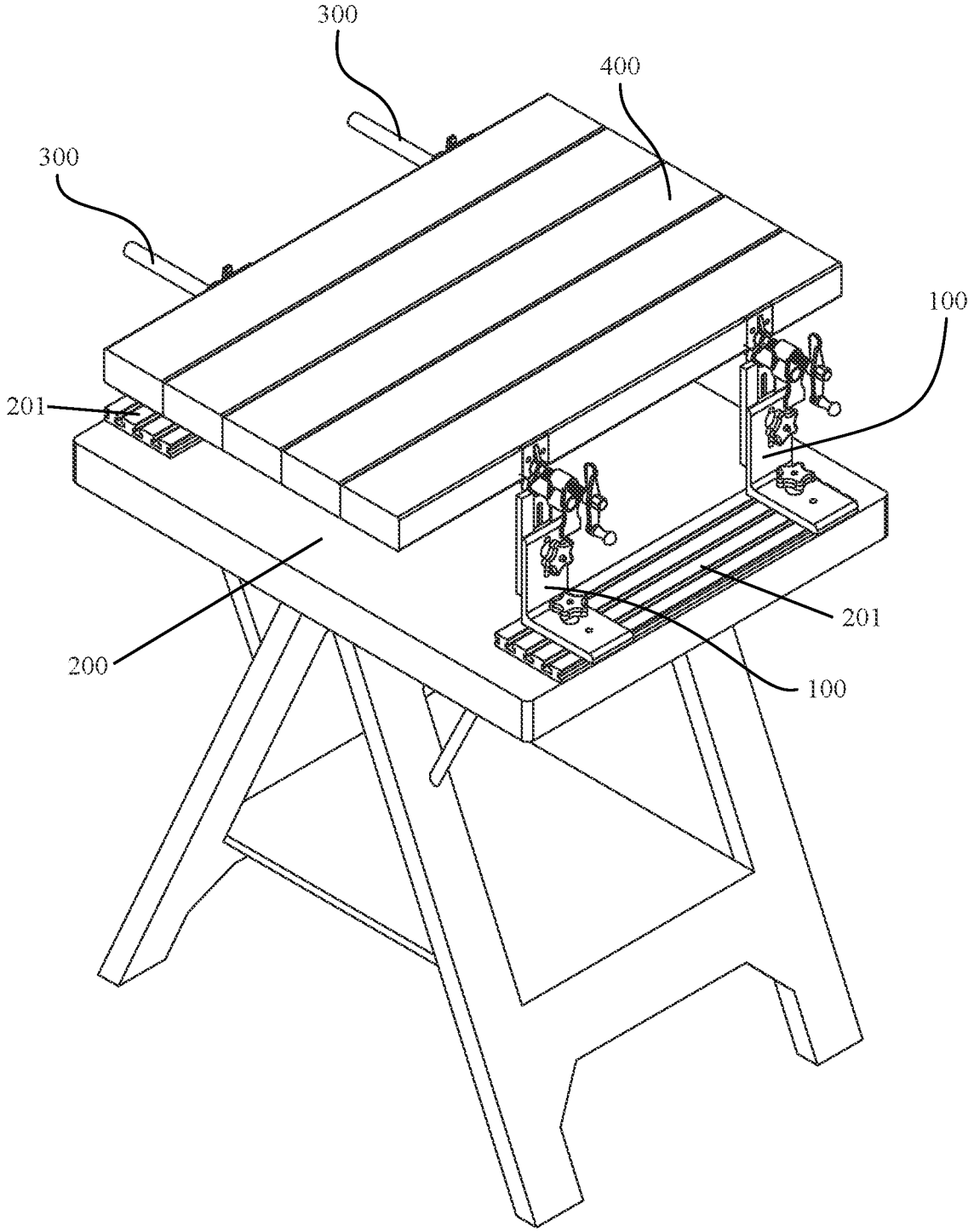
FIG. 9 provides a perspective view of an exemplary workbench securing a plurality of clamp leveling devices supporting a woodworking clamp, according to an embodiment of the present invention.

The present invention concerns a woodworking leveling device incorporated into a workbench or other working surface for woodworking. FIG. 1 provides a view of an exemplary woodworking workbench 200 incorporating the clamp leveling device 100, of FIGS. 2-8B, each is supporting a bar clamp 300. The exemplary workbench 200 includes a tabletop 200 having a pair of exemplary T-slot fixture plates 201 positioned on opposite sides of the tabletop about the center of the tabletop. The exemplary T-slot fixture plates 201 includes three T-slots for use with T-slot nuts, bolts, and setup studs and is operable to anchor objects to the tabletop 200 temporarily. The exemplary bar clamp 300 may include a bar 300A, first plate 301, a second plate 302, and a tightening screw 303 that is operable to advance the first plate 301, thereby reducing the space between the first plate and second plate to compress a workpiece. The clamp leveling devices 100 may be operable to finely adjust each end of the bar 300A and thus the attitude of the bar 300A and the bar clamp 300 in a free space above the tabletop 200. FIG. 9 illustrates the workbench 200 of FIG. 1 and includes a workpiece 400 lifted off the workbench 200 from the clamp leveling device 100. The elevation of the workpiece 400 provides a space operable to allow for cauls and clamps to be positioned on the top and bottom surfaces of the workpiece 400 to prevent vertical slip of workpiece panels.

Figure 5:
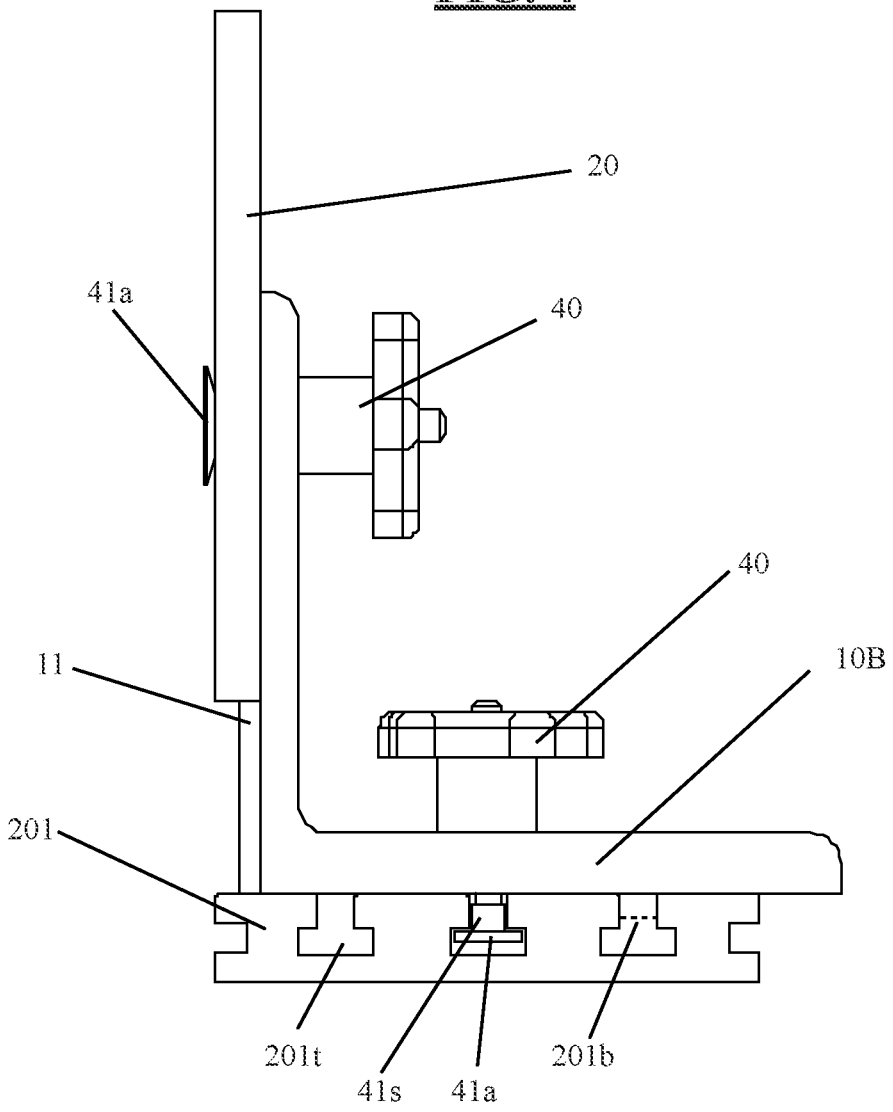
FIG. 5 provides a side view of a clamp leveling device attached to a workbench, according to an embodiment of the present invention.
Figure 6:
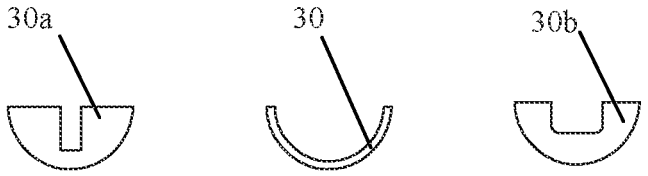
FIG. 6 provides a front view of a clamp leveling device component, according to an embodiment of the present invention.
Figure 7:
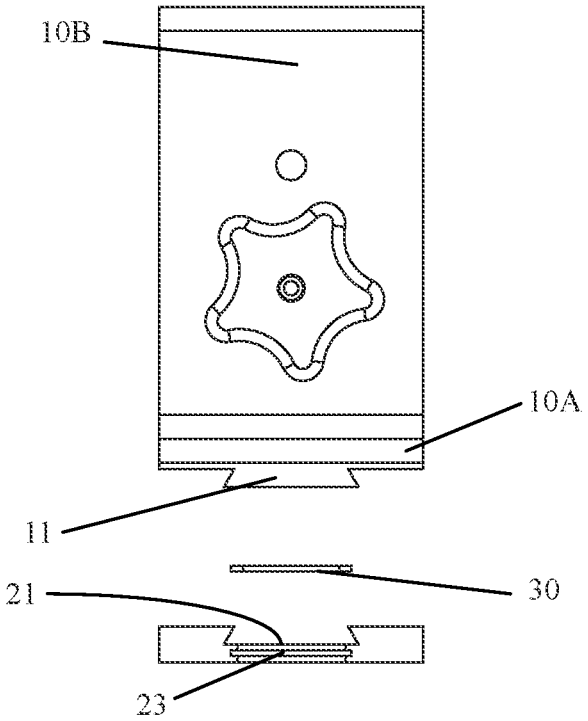
FIG. 7 provides an exploded top view of a clamp leveling device, according to an embodiment of the present invention.

The clamp leveling device 100, according to the present invention, may include two pieces, (1) an angle bracket 10 (e.g., L-bracket) having a bottom plate 10B, a vertical plate 10A, an inner surface (e.g., surface within the plate junction), and an outer surface (e.g., surface outside the plate junction), and (2) an alignment plate 20 having a front side 20A with a channel 21, a top surface 20T, and a rear side 20B, the alignment plate being operable to slidably engage with the angle brackets vertical plate 10A. The clamp leveling device 100 is illustrated in FIGS. 2-8B. The vertical plate 10A may have a protruded guide 11 operable to align the alignment plate 20 with the angle brackets vertical plate 10A and allow linear motion along the face of the plate 10A. The vertical plate may have a centrally positioned slot 12 to receive a bolt of a similar size. The alignment plate 20 channel 21 may have a geometry complementary to the protruded guide 11, and the top surface 20T may have a concavity 22 operable to receive an insert 30, as shown in FIG. 7. The channel 21 and protruded guide 11 may have a dovetail-like geometry for limiting the motion of the alignment plate 20 to linear motion. The alignment plate 20 may have a slot 22 with a geometry complementary to that of the vertical plate slot 12. The slots 12 and 22 of the leveling device 100 may be aligned and may receive a fastener 40 that operates like a pin, thereby limiting the extension of the alignment plate 20 with respect to the angle bracket slot 12. The fastener may have a diameter complementary to slots 12, 22. The maximum extension height of the alignment plate 20 with respect to the angle bracket 10 is shown in FIG. 8A, and the minimum height of the alignment plate 20 with respect to the angle bracket 10 is shown in FIG. 8B. The position of the alignment plate 20 may be set with a fastener knob 40 that engages with the fastener 40 and may fix the position of plate 20 between the maximum and minimum allowable heights.

In some embodiments, the alignment plate 20 may have a concavity 22 operable to receive a bottom edge 30*e* of a removable and replaceable insert 30 that is operable to centrally position the shaft of a bar clamp 300 along the center of the alignment plate 20. Bar clamps 300 are manufactured from various producers and may have, for example, rectangular, square, or circular shaft geometries of varying sizes that are mainly dependent on the producer. Thus the removable and replaceable insert 30 may provide a varying alignment geometry operable to support varying shapes and sizes of the shaft of a bar 300A in a centered position. FIG. 6 shows non-limiting examples of a plurality of removable and replaceable inserts, each having a bottom edge 30*e* complementary to the alignment plate concavity 23. The insert 30*a* may have an upper edge geometry operable to receive a bar 300A shaft of varying cross-sectional geometries and sizes. The insert 30 may have an upper edge geometry operable to receive a substantially circular bar clamp shaft, and the insert 30*b* may be operable to receive a substantially square bar clamp shaft. The alignment geometry of the insert 30 is operable to secure a bar clamp 300 at the centerline of the leveling device 100.

In some embodiments, the leveling device 100 base plate 10B of the angle bracket 10 may be fixedly attached to a workbench with a fastener (e.g., screw) at through-hole 15. In other embodiments, as illustrated in FIGS. 1, 5, and 9 the base plate 10B may be secured to a T-slot rail 201 with a fastener 41 that has a square portion 41*s* immediately adjacent to the fastener base 41*a* and is operable to prevent the fastener 41 from rotating in the T-slot 201*t* when positioning leveling device 100. The T-slot rail 201 may have a narrow passage 201*b* and a wide passage 201*t* the T-slot rail may receive the fastener 41 on either of the rails ends, and the angle bracket may be positioned over the fastener 41, and the fastening knob 40 may be turned to compress the base plate 10B between the T-slot rail 201 and the fastening knob 40. The leveling devices 100 in such embodiments may be positioned anywhere along the path of the T-slot rail 201. The base 41*a* compresses against the bottom surface of the narrow passage 201*b*. Similarly, the fastener 41 compresses the fastener base 41*a* against the alignment plate's rear surface 20B and the fastening knob 40 against the vertical plate 10A.

In some embodiments, a plurality of leveling devices 100 may be positioned in the T-slots 201 on different sides of a workbench 200 to position a workpiece in free space above a tabletop 201T and apply adequate pressure to the periphery of the workpiece. For example, a pair of leveling devices may be positioned on a right side of a workbench, and a second pair of leveling devices may be positioned on a left side of a workbench, where one leveling device in each pair is symmetrically positioned about a workbench centerline. Each of the alignment plates 20 may be calibrated with a level.

CONCLUSION/SUMMARY

The present invention provides a clamp leveling device operable to elevate a wood workpiece during glue-ups to provide space above and below the workpiece for cauls and clamps. The present leveling devices incorporate an adjustable height leveling plate with an insert operable to receive a plurality of different conventional woodworking bar clamps. It is to be understood that variations, modifications, and permutations of embodiments of the present invention, and uses thereof, may be made without departing from the scope of the invention. It is also to be understood that the present invention is not limited by the specific embodiments, descriptions, illustrations, or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A clamp leveling device for adjustably elevating a workpiece above a workbench comprising: a. an angle bracket having a base plate securing to the workbench with a fastener and a vertical plate orthogonal to an edge of said base plate, said vertical plate having a central positioning slot and a linear guide; b. an alignment plate having a central alignment slot, a recess on a top surface operable to receive a bar clamp shaft and position said bar clamp above a top surface of the workbench, and a front surface with a channel operable to slidably engage with said linear guide; and c. an alignment fastener positioned through said positioning slot and said alignment slot and operable to secure said alignment plate to the angle bracket with a fastening knob, wherein the elongated position of said alignment plate is configured by sliding said alignment plate along the linear guide and is anchored with said alignment fastener and fastening knob.

2. The device of claim 1, wherein said workbench includes a T-slot track for receiving said fastener in said base plate and allowing adjustments to position said leveling device.

3. The device of claim 1, wherein said linear guide has a dovetail geometry protruding from a back surface and said alignment plate channel has a geometry complementary to said dovetail geometry.

4. The device of claim 1, wherein said central positioning slot and said central alignment slot have a same width and complement a diameter of said alignment fastener.

5. The device of claim 1, wherein said fastening knob is operable to engage with threading of said alignment fastener.

6. The device of claim 2, wherein said fastener in said base plate engages with threading of a second fastening knob.

7. The device of claim 1, wherein said recess further includes a slot operable to receive a removable and replaceable alignment insert, wherein said alignment insert has a geometry complementary to geometry of said bar clamp shaft.

8. The device of claim 1, further comprising a second leveling devices secured to opposite sides of said workbench and having a position that is symmetric to a position of said leveling device about a centerline of said workbench such that said leveling device and said second leveling device are operable to support opposite ends of said bar clamp.

9. The device of claim 8, wherein said leveling device and said second leveling devices are adjustable to position a workpiece in a level horizontal attitude in a free space above said workbench.

10. The device of claim 1, wherein said elongated position may adjust a bar clamp height at a range of about five inches to about eight and three-quarter inches above said top surface of the workbench.

11. A method for positioning a bar clamp leveling device and a workpiece above a workbench, the method comprising: a. positioning and fastening a pair of clamp leveling devices to opposite ends of a workbench T-slot, each said clamp leveling device of the pair of clamp leveling devices comprising: i. an angled bracket having a T-slot bolt protruding through a base plate, and a vertical plate having a centering slot and a linear guide; and ii. alignment plate having a channel operable to slidably engage with said vertical plate and an alignment slot operable to receive a fastener for securing said alignment plate to said vertical plate with a fastening knob; b. adjusting a height of each said alignment plate such that a top surface of each said alignment plate is level, and anchoring said alignment plate to each said clamp leveling device of the pair of clamp leveling devices with said fastener and said fastening knob; c. positioning a bar clamp shaft into a recess of each of said alignment plates top surfaces; and d. securing said workpiece above a top surface of said workbench with said pair of clamp leveling devices, wherein said pair of clamp leveling devices are symmetrical about a centerline of said workbench and may be repeatedly positioned along said workbench T-slot to provide multiple clamping points on said workpiece.

12. The method of claim 11, wherein said pair of clamp leveling devices are adjusted at a same height and have a same position in each of said workbench T-slots.

13. The method of claim 11, wherein said workpiece is elevated at a position operable to receive a plurality of cauls and clamps on a top and a bottom surface for preventing vertical slip panels in said workpiece.

14. A clamp leveling device for elevating a workpiece above a workbench comprising: a. an angle bracket having a base plate securing to a workbench with a fastener and a vertical plate orthogonal to an edge of said base plate, said vertical plate having a central positioning slot and a linear guide; b. an alignment plate having a central alignment slot and being operable to receive a bar clamp shaft, and a front surface with a channel operable to engage with said linear guide slidably; and c. an alignment fastener positioned through said positioning slot and said alignment slot and operable to secure said alignment plate to the angle bracket with a fastening knob, wherein an elongated position of said alignment plate is configured by sliding said alignment plate along the linear guide.

15. The device of claim 14, wherein said workbench includes a T-slot track for receiving said fastener in said base plate and providing adjustments to a position of said leveling device.

16. The device of claim 14, wherein said linear guide has a dovetail geometry protruding from said back surface and said alignment plate channel has a geometry complementary to said dovetail geometry.

17. The device of claim 14, wherein said central positioning slot and central alignment slot have a same width and complement a diameter of said alignment fastener.

18. The device of claim 14, wherein said fastening knob is operable to engage with threading of said alignment fastener.

19. The device of claim 14, wherein said base plate fastener engages with threading of a second fastening knob.

20. The device of claim 14, further comprising an alignment plate recess that includes a slot operable to receive a removable and replaceable alignment insert, wherein said alignment insert has a geometry complementary to a geometry of said bar clamp shaft.

* * * * *